US005217069A

United States Patent [19]

Badon

[11] Patent Number: 5,217,069

[45] Date of Patent: Jun. 8, 1993

[54] SUCKER ROD WIPER

[76] Inventor: Bobby Badon, 315 St. Pierre Blvd., Carencro, La. 70520

[21] Appl. No.: 813,440

[22] Filed: Dec. 26, 1991

[51] Int. Cl.[5] ..... E21B 33/08

[52] U.S. Cl. ..... 166/84; 15/220.4

[58] Field of Search ..... 166/82, 84, 85, 81; 15/104.04, 220.4

[56] References Cited

U.S. PATENT DOCUMENTS

| | | | |
|---|---|---|---|
| 1,773,137 | 8/1930 | Fuller et al. | 166/82 X |
| 2,444,653 | 7/1948 | Kennedy et al. | 15/220 X |
| 2,611,146 | 9/1952 | Buckley | 15/220 X |
| 2,697,240 | 12/1954 | Barnes et al. | 166/82 X |
| 2,787,801 | 4/1957 | Butler | 15/220 X |
| 3,061,862 | 11/1962 | Minor | 15/220 X |
| 3,475,781 | 11/1969 | Grant | 15/210 |
| 3,902,215 | 9/1975 | Waldrop et al. | 166/82 X |
| 3,921,991 | 11/1975 | Beck | 277/205 |
| 4,050,514 | 9/1977 | Prenn | 166/176 |
| 4,279,300 | 7/1981 | Wirsch | 166/90 |
| 4,494,607 | 1/1985 | Ford et al. | 166/311 |

*Primary Examiner*—Stephen J. Novosad
*Attorney, Agent, or Firm*—Norman B. Rainer

[57] ABSTRACT

A wiper device for oil well sucker rods is provided as an integral resilient body fabricated of an oil-resistant elastomeric composition. The resilient body is bounded in part by upper, lower and sidewall surfaces. A flat annular base portion extends inwardly from the sidewall surface. An interior portion of frustro-conical shape extends upwardly from the base portion and terminates in an orifice adapted to embrace the sucker rod. A reinforcing band is embedded within the base portion to provide structural stability.

1 Claim, 1 Drawing Sheet

SUCKER ROD WIPER

BACKGROUND OF THE INVENTION

1. Field of the Invention

This invention relates to the art of drilling and producing hydrocarbons from an oil well, and more particularly concerns the wiping of a sucker rod as it is withdrawn from a borehole.

2. Description of the Prior Art

In oil well operations, various tubular goods, such as drill pipe, production tubing, and sucker rod must be used downhole in the borehole. In producing the well, it is commonplace to utilize a pump-jack unit which reciprocates a string of sucker rod. The sucker rod extends downhole to a downhole pump. The pump-jack unit reciprocates the rod string which in turn reciprocates the downhole pump so that oil is raised during the upward stroke. Flap valve means at the bottom of the borehole closes on the down stroke to prevent oil from moving back downwardly.

A string of sucker rod is made up of individual joints which are approximately 25 feet in length. The rod joints are connected together by a coupling member. The string of sucker rod may be more than a mile in length. In order to prevent frictional wear of the rod joints against the production tubing, guide units are often emplaced upon the rods at frequent intervals. The guide units are generally comprised of a rubber portion that extends radially outward from the sucker rod to establish sliding contact with the production tubing.

From time to time, it is necessary to pull the entire rod string out of the borehole so that various different repairs or changes can be made to the oil well. This necessitates unscrewing each joint as the string is lifted from the hole. The sucker rod joints are then stacked until the work on the well has been completed and then the rod joints are made back into a string by reversing the above procedure.

The sucker rod often accumulates a coating comprised of paraffin, scale, oxidation products, and other debris. During the lifting operation, it is desired to remove said coating for proper maintenance of the sucker rod and also for the purposes of maintaining a cleaner work environment and preventing the coating ingredients from polluting regions adjacent the oil well.

The wiping of the coating from the sucker rod is often attempted manually with rags, gloves, or other materials. However, this is very dangerous to personnel and often inefficient. Devices have earlier been disclosed for wiping sucker rods, but such devices are unable to accommodate the guides which extend radially from the rod. Other earlier rodwiping devices have been either of complex construction or difficult to install and maintain in proper operating condition.

It is accordingly an object of the present invention to provide a wiping device for the efficient cleaning of sucker rods in an oil well installation.

It is a further object of this invention to provide a device as in the foregoing object which will function effectively on a sucker rod having radially extending guides.

It is a another object of the present invention to provide a device of the aforesaid nature which is easily installable and resistant to malfunction during use.

It is a still further object of this invention to provide a device of the aforesaid nature of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a wiping device comprised of:

1) an integral resilient body fabricated of an oil-resistant elastomeric composition having a durometer hardness between 35 and 45, and comprised of:

a) upper and lower surfaces and a circular perimeter, b) a flat annular base portion extending inwardly from said perimeter and terminating in an interior boundary of circular contour and coaxially disposed with respect to said perimeter, and c) an interior portion inwardly and upwardly directed from said interior boundary, having a frustro-conical shape having an upward angle with respect to the base portion in the range of 12 to 18 degrees, and terminating in a circular aperture coaxial with said perimeter, and 2) a reinforcing band embedded within said base portion.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
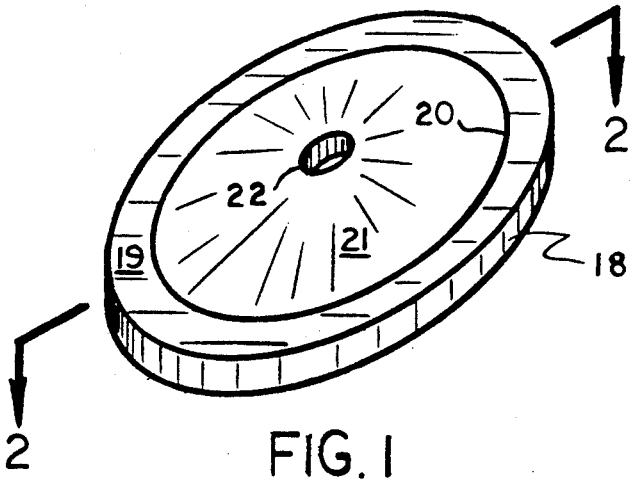
FIG. 1 is a top perspective view of an embodiment of the wiper device of the present invention.
Figure 2:
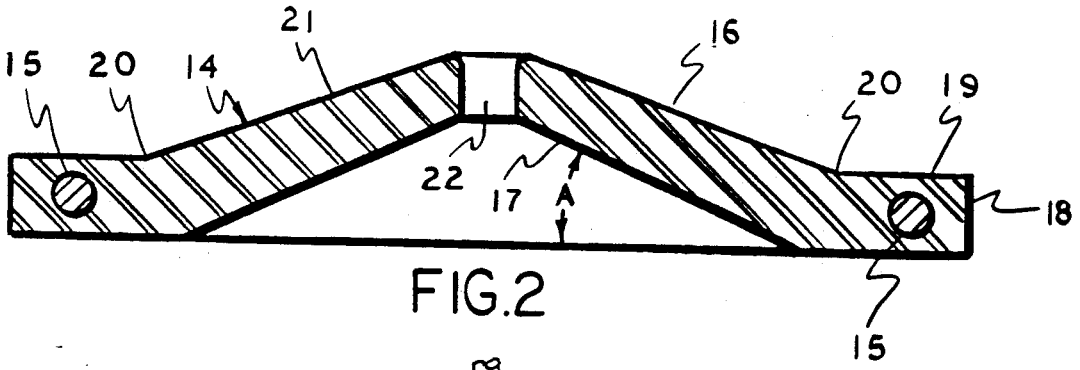
FIG. 2 is a sectional view taken upon the line 2—2 of FIG. 1.
Figure 3:
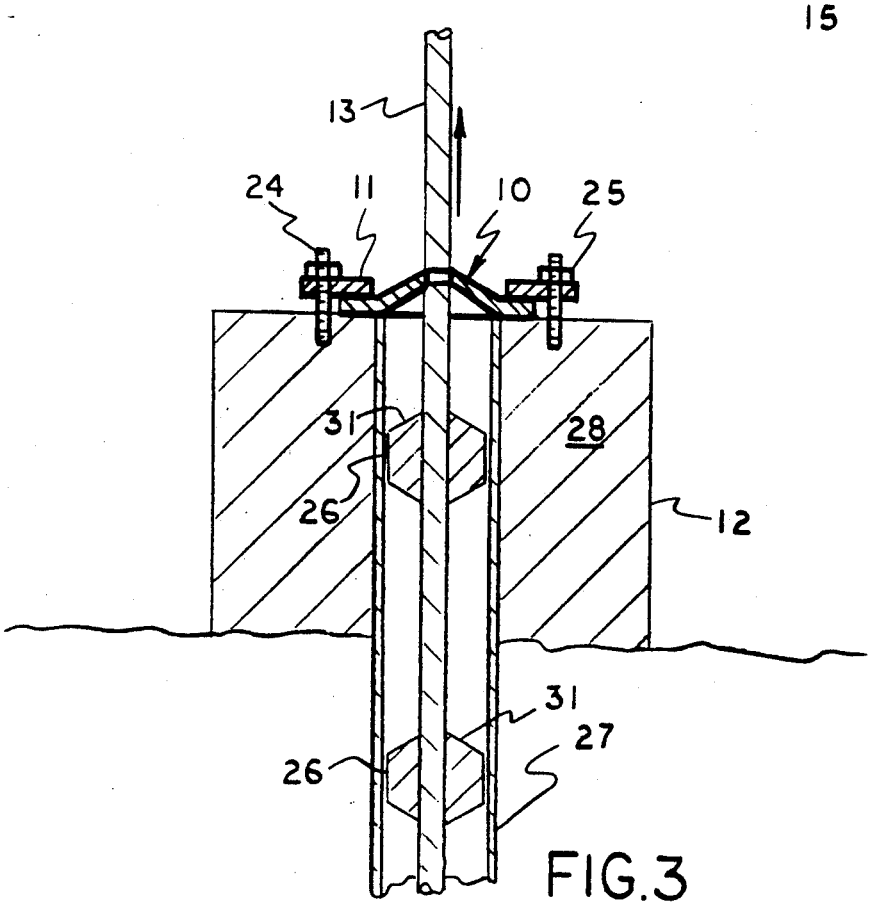
FIG. 3 is a schematic view showing the embodiment of FIG. 1 in functional association with an oil well.

Referring to FIGS. 1–3, an embodiment of the wiper device 10 of this invention is shown positioned by clamping ring 11 upon a well head 12 and in sliding engagement with upwardly moving sucker rod 13 equipped with guide units 26 having tapered extremities 31.

The wiper device is preferably fabricated in a molding operation utilizing an oil-resistant elastomeric composition such as polyurethane, nitrile rubber, fluoroelastomer and silicone. The elastomeric composition, by virtue of its degree of polymerization, extent of cross-linking, or special additives, has a Shore Durometer hardness in the range of 35 to 45. It has been found that compositions that are too soft wear out quickly and do not provide adequate wiping force against the sucker rod. Compositions that are too hard provide a wiper that does not adequately conform to the varied diameters of the sucker rod and attached guides, and is susceptible to splitting. A further consequence of using too hard an elastomeric composition is that the wiper device will then push the guide units 26 to lower positions on sucker rod 13.

The wiper device is comprised of integral resilient body 14 and reinforcing band 15 embedded within said body by virtue of the aforesaid molding operation. Body 14 is bounded in part by upper, lower and sidewall surfaces 16, 17, and 18, respectively, said sidewall surface being of circular cylindric configuration and defining a circular perimeter of said body 14.

A flat annular base portion 19 extends inwardly from said perimeter and terminates in an interior boundary 20 of circular contour and coaxially disposed with respect to said perimeter.

An interior portion 21 emerges from boundary 20 as a continuous integral extension of said base portion, and is inwardly and upwardly directed with respect to said base portion. Said interior portion has a frustro-conical shape having an upward angle A with respect to the base portion in the range of 12 to 18 degrees. Such angles generally correspond to the angle of the upper tapered extremity of guide units 26. Angles smaller than about 12 degrees promote tearing of the wiper device. The uppermost extremity of interior portion 21 terminates in a circular aperture 22 coaxially disposed with said perimeter. The diameter of aperture 22 is selected to be slightly smaller than the diameter of the sucker rod which will be caused to pass through said aperture.

In preferred embodiments, the body 14 is of substantially uniform thickness, measured orthogonally between said upper and lower surfaces, said thickness being preferably in the range of ½ inch to one inch. The diameter of perimeter 18 may range from about 8" to 12".

Reinforcing band 15 is preferably a ring of metal construction such as steel, and is substantially centered within base portion 19. The cross-sectional thickness and configuration of the reinforcing band is such as to impart sufficient rigidity as to resist deformation in any direction.

By virtue of the specialized construction of the wiper device of this invention, sucker rod 13, having guides 26 affixed thereto may be efficiently cleaned while being lifted out of the borehole 27. The wiper device is easily attached to the well head 28 by circular clamping ring 11 which is held in place by penetrating threaded bolts 24 and wing nuts 25. The reinforcing band 15 provides sufficient structural stabilization to permit the wiper device to be securely held by clamping ring 11.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A sucker rod wiping device comprised of:

1) an integral resilient body fabricated of an oil-resistant elastomeric composition having an durometer hardness between 35 and 45, and comprised of:
   a) upper, lower and sidewall surfaces, said sidewall surface being of circular cylindric configuration and defining a circular perimeter of said body having a diameter in the range of 8 to 12 inches,
   b) a flat annular base portion extending inwardly from said perimeter and terminating in an interior boundary of circular contour and coaxially disposed with respect to said perimeter, and
   c) an interior portion inwardly and upwardly directed from said interior boundary as a continuous extension of said base portion, having an open-bottomed frustro-conical shape having an upward angle with respect to said base portion in the range of 12 to 18 degrees, and terminating in a circular aperture coaxial with said perimeter, said aperture having a diameter slightly smaller than the diameter of said sucker rod, and
2) a rigid circular ring of steel embedded centrally within said base portion,
3) said wiping device being of substantially uniform thickness as measured orthogonally between said upper and lower surfaces.

* * * * *